United States Patent [19]

Kanazawa

[11] 4,385,875

[45] May 31, 1983

[54] ROTARY COMPRESSOR WITH FLUID DIODE CHECK VALUE FOR LUBRICATING PUMP

[75] Inventor: Takaki Kanazawa, Fuji, Japan

[73] Assignee: Tokyo Shibaura Denki Kabushiki Kaisha, Kanagawa, Japan

[21] Appl. No.: 170,918

[22] Filed: Jul. 21, 1980

[30] Foreign Application Priority Data

Jul. 28, 1979 [JP] Japan ..... 54-96381
Jul. 28, 1979 [JP] Japan ..... 54-96382
Dec. 21, 1979 [JP] Japan ..... 54-166355

[51] Int. Cl.[3] ..... F04C 18/00; F04C 29/02; F15C 1/16

[52] U.S. Cl. ..... 418/63; 418/87; 418/88; 137/812

[58] Field of Search ..... 418/63, 66, 67, 87, 418/88, 248; 137/812

[56] References Cited

U.S. PATENT DOCUMENTS 2,212,717 8/1940 Penn ..... 418/88
2,422,972 6/1947 Knowles ..... 418/66
3,324,891 6/1967 Rhoades ..... 137/812
4,112,977 9/1978 Syred et al. ..... 137/812
4,219,314 8/1980 Haggerty ..... 418/63
4,249,575 2/1981 Syred et al. ..... 137/812

FOREIGN PATENT DOCUMENTS 54-31918 3/1979 Japan ..... 418/63

*Primary Examiner*—John J. Vrablik
*Attorney, Agent, or Firm*—Stevens, Davis, Miller & Mosher

[57] ABSTRACT

In a rotary compressor unit including a compressor comprising a rotor rotatable in a cylinder, a blade in contact with an outer surface of the rotor and reciprocated thereby in a radial direction in a closed chamber formed in the cylinder, the chamber being defined by longitudinally spaced apart end plates on both sides of the cylinder, suction and discharge and passages opening through the end plates into the closed chamber, and a check valve provided at least in the suction passage, the check valve comprises a fluid diode.

1 Claim, 8 Drawing Figures

ROTARY COMPRESSOR WITH FLUID DIODE CHECK VALUE FOR LUBRICATING PUMP

BACKGROUND OF THE INVENTION

This invention relates to rotary compressor units, and more particularly to a horizontal type compressor unit provided with a lubricating oil pumping mechanism including fluid diode check valves.

Ordinarily, a vertical type rotary compressor unit has been used in a refrigerating apparatus. However, the rotary compressor unit comprising an electric motor and a rotary compressor vertically disposed in a casing has a height substantially larger than the diameter thereof. Thus, when the rotary compressor unit is incorporated into a refrigerating apparatus of a horizontally elongated construction, the arrangement of the parts of the apparatus is restricted by the height of the vertical rotary compressor unit.

Furthermore, the electric motor and the compressor are ordinarily fixed rigidly to the internal structure of the casing, and therefore severe vibrations tend to be created, particularly when the rotary compressor is of a single vane type. The vibration inevitably creates noise, and often breaks pipe connections between the compressor unit and various parts of the refrigerating apparatus, resulting in a leakage of the refrigerant gas.

In order to eliminate the above described disadvantages of the vertical type compressor unit, there has been proposed a horizontal type compressor unit wherein the compressor and the electric motor are disposed horizontally. In this type of the rotary compressor unit, there is included a rotary compressor comprising a rotor rotatable in a cylinder, a blade held in contact with the outer surface of the rotor and reciprocates in a radial direction in the cylinder, a chamber defined by end plates longitudinally spaced apart on both sides of the cylinder, suction and discharge passages opening through the end plates into the closed chamber, and a check valve provided at least in the suction passage.

However, since the check valve of the conventional compressor unit is of a mechanical type, various disadvantages such as creating noise, rapidly wearing, and difficulties in installation and repair are caused.

SUMMARY OF THE INVENTION

A primary object of the present invention is to provide a horizontal type rotary compressor unit utilizing an improved check valve including no moving part but capable of adequately supplying lubricant to the motor and compressor.

According to the present invention, there is provided a rotary compressor unit including a compressor comprising a rotor rotatable in a cylinder, a blade in contact with an outer surface of the rotor and reciprocated thereby in a radial direction in a closed chamber formed in the cylinder, the chamber being defined by longitudinally spaced end plates on both sides of the cylinder, suction and discharge passages opening through the end plates into the closed chamber, and a check valve provided for at least in the suction passage, characterized in that the check valve is a fluid diode.

DESCRIPTION OF THE PREFERRED EMBODIMENTS

Figure 1:
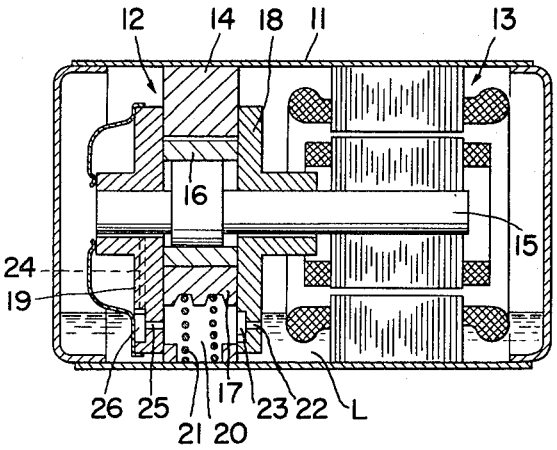
FIG. 1 is a longitudinal sectional view of a first embodiment of a rotary compressor unit according to the present invention.

Referring now to FIG. 1, there is illustrated a preferred embodiment of a horizontal type rotary compressor unit of present invention comprising a rotary compressor 12 and an electric motor 13 directly coupled with the compressor 12, both contained in a casing 11. The rotary compressor 12 comprises a hollow cylinder 14 secured to the casing 11, a roller 16 rotated eccentrically within the cylinder 14 by a driving shaft 15 which is commonly provided for both the compressor 12 and the motor 13, a blade 17 in reciprocable contact with the roller 16, and end plates 18 and 19 secured to the opposite ends of the cylinder 14 in a fluid tight manner. Each end plate has a portion shaped into a journal bearing rotatably supporting the driving shaft 15. A lower portion inside of the casing 11 is filled with lubricating oil L so that the lower portions of the end plates 18 and 19 are submerged in the oil L. In a portion radially outwardly of the blade 17 of the cylinder 14, is formed a closed space 20 which is defined by the end plates 18 and 19. The closed space 20 contains a spring 21 urging the blade 17 toward the eccentric roller 16.

Through the lower part of the end plates 18 and 19 submerged in the lubricating oil L, are provided passages 22 and 25 respectively for communicating the closed space 20 with the lower portion of the casing 11 filled with the lubricating oil. A fluid diode 23 is provided in the passage 22 at the inner end thereof opening into the closed space 20, and another fluid diode 26 is provided in the passage 25 at an end away from the closed space 20.

A vertical passage 24 is provided through the end plate 19 for supplying the lubricating oil L to the bearing of the rotary compressor.

Figure 2:
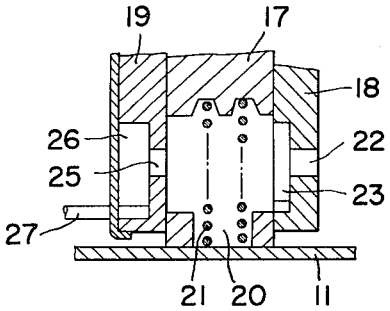
FIG. 2 is an enlarged view showing a portion of FIG. 1, wherein the passage in an end plate is slightly modified.

In FIG. 2, there is illustrated a modification of the embodiment shown in FIG. 1, wherein the above described passage 24 is omitted, and a conduit 27 is connected to the discharge port of the fluid diode 26 as will be made clear hereinafter.

Figure 3:
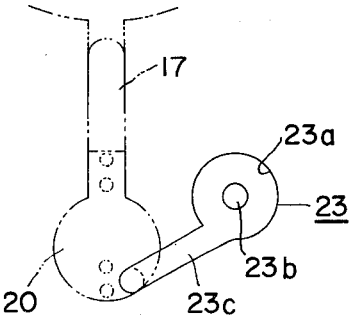
FIGS. 3 and 4 are diagrams showing two fluid diodes provided in two end plates.
Figure 4:
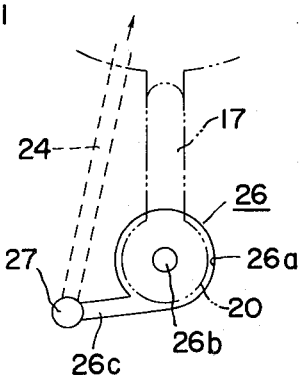

In FIGS. 3 and 4, there are shown the fluid diodes 23 and 26 provided in the passages 22 and 25, respectively. The fluid diodes 23 and 26 have disc-shaped chambers **23*a* and 26*a*, first fluid passages 23*b* and 26*b* extending outwardly from the central ports of the disc-shaped chambers 23*a* and 26*a*, and second fluid passages 23*c* and 26*c* each extending tangentially from a periphery of the disc-shaped chamber, so that the fluid entering into the chamber from the second passage at a high speed is forced away from the central port. The fluid diodes 23** and 26 may be formed in the lower portions of the end plates, which may be made of a sintered alloy or of a metal plate.

In the embodiment shown in FIG. 1, the first passage 23*b* of the fluid diode 23 is connected to the passage 22 through the end plate 18, and the second passage 23*c* of the same diode 23 is opened into the closed space 20 as shown in FIG. 3, while the first passage 26*b* of the fluid diode 26 is connected to the passage 25 through the end plate 19, and the second passage 26*c* of the same diode 26 is connected to the oil supplying passage 24 provided in the end plate 19.

In the modification shown in FIG. 2, a lubricating oil supplying pipe 27 is provided instead of the oil supplying passage 24, and therefore the second passage 26*c* of the fluid diode 26 is connected with the lubricating oil supplying pipe 27 as shown in FIG. 4, while the fluid diode 23 is connected as in the case of FIG. 1.

In either of the embodiment shown in FIG. 1 and a modification thereof shown in FIG. 2, means are provided so that the lubricating oil supplied through the passage 24 or the pipe 27 is delivered to the bearing through the end plates 18 and 19, although such means are not indicated clearly.

The rotary compressor unit described above operates as follows.

When the driving shaft 15 of the roller 16 is rotated, the roller 16 rotates eccentrically within the cylinder 14, thus reciprocating the blade 17. The reciprocation of the blade 17 creates a pumping effect in the closed space 20, so that the lubricating oil L in the lower portion of the casing 11 is sucked into the closed space 11, and then forced into the oil supplying passage 24 or the oil supplying pipe 27.

More specifically, when the blade 17 moves radially inwardly toward the roller 16, a negative pressure is created in the closed space 20. Thus, the lubricating oil in the casing 11 is sucked into the closed space 20 to flow into the fluid diode 23 from the first passage 23*b* into the disc-shaped chamber 23*a* and then into the second passage 23*c* of the fluid diode 23.

The negative pressure created in the closed space 20 also acts upon the fluid diode 26 provided in the passage 25. In this case, however, actually no lubricating oil is allowed to flow through the fluid diode 26 reversely from the second passage 26*c* to the disc-shaped chamber 26*a* and then to the first passage 26*b*, thus preventing the flow of the lubricating oil from the lubricating oil supplying passage 24 or the lubricating oil supplying pipe 27 to the closed space 20.

When the blade 17 starts to move outwardly, a positive pressure is created in the closed space 20. Thus the fluid diode 23 is blocked by the positive pressure of the reverse direction, while the fluid diode 26 operates forwardly so as to supply the lubricating oil from the space 20 via the passage 25, first passage 26*b*, disc-shaped chamber 26*a*, and the second passage 26*c* to the lubricating oil supplying passage 24 or to the lubricating oil supplying pipe 27.

Thus, a sufficient quantity of lubricating oil is supplied to the bearing regardless of the horizontally disposed construction of the compressor unit, and the above pointed out disadvantages not only of the vertical type but also of the horizontal type rotary compressor unit having a mechanical check valve can be eliminated.

In FIGS. 5 through 8, there is illustrated still another embodiment of the present invention.

The entire construction and components of this embodiment are similar to those shown in FIG. 1, except that the lower portions of the end plates 18 and 19 defining the closed space 20 in the first embodiment are made of a piece of a press-shaped metal plate 32. A spring 21 is contained in the closed space as in other embodiments for urging the blade 17 toward the eccentric roller 16.

The metal plate 32 is formed into a channel shape having a bottom wall 32*a* and two side walls 32*b* and 32*c* extending in a juxtaposed relation along the longitudinally spaced apart surfaces of the cylinder 14 in a fluid tight manner, so that the closed space 20 formed therein to receive the blade 17 is defined by the longitudinally spaced side plates 32*b* and 32*c*.

Figure 5:
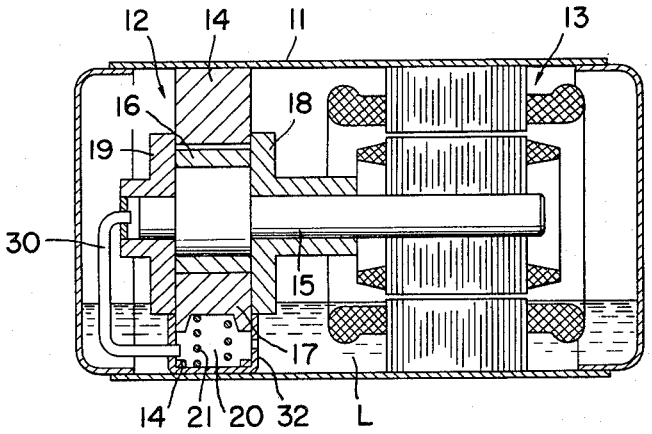
FIG. 5 is a longitudinal sectional view showing another embodiment of the rotary compressor unit of present invention.
Figure 6:
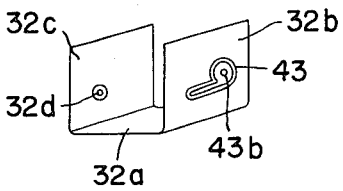
FIGS. 6 and 7 are a perspective view and a cross-sectional view of a shaped metal plate constituting the lower parts of the end plates.
Figure 7:
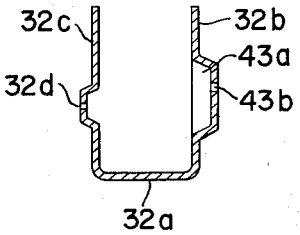

A fluid diode 43 is provided at a suitable position on the side wall 32*b* for introducing the lubricating oil stored in the lower portion of the casing 11 into the closed space 20. A suitable portion of the side wall 32*c* is press-shaped to slightly project outwardly, and a hole 32*d* which may be connected with an oil supplying pipe 30 as shown in FIG. 5 is provided through the outwardly projecting part of the side wall 32*c*.

Figure 8:
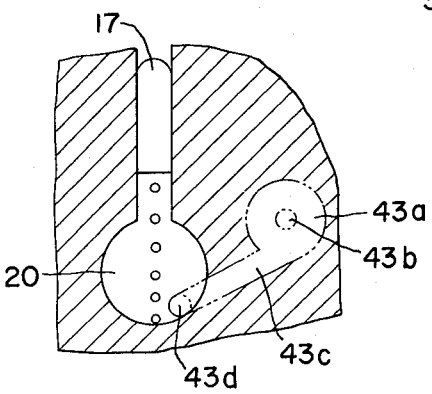
FIG. 8 is a diagrammatic representation useful to explain the operation of the second embodiment of the invention.

The fluid diode 43 has a disc-shaped chamber 43*a*, a central passage 43*b* communicating the disc-shaped chamber 43*a* with the lower portion of the casing 11 where the lubricating oil is stored, and a fluid passage 43*c* extending tangentially from the periphery of the disc-shaped chamber 43*a*. The outer end of the passage 43*c* opens at 43*d* as shown in FIG. 8 in the closed space 20 formed on the rear side of the blade 17. Thus, when the blade 17 moves out of the closed space 20, a negative pressure is created in the closed space 20.

The negative pressure created in the closed space 20 causes the lubricating oil L stored in the lower portion of the casing 11 to flow through the fluid diode 43 forwardly into the closed space 20.

When the blade 17 moves into the closed space 20, a positive pressure is created in the space 20, and the lubricating oil previously introduced into the closed space 20 is forced to flow through the hole 32*d* and the pipe 30 connected therewith to the sliding parts of the compressor.

The positive pressure in the space 20 tends to send the lubricating oil contained therein back into the lower portion of the casing 11 through the fluid diode 43. However, the flow resistance of the fluid diode 43 for the backward flow of the fluid is far greater than that for the forward flow of the fluid, and therefore the backward flow of the lubricating oil to the lower portion of the casing 11 is substantially prevented since when the oil flows into the casing from the closed space the oil flows circumferentially about opening 32*d* or 43*a* and does not readily pass through the openings.

I claim:

1. A rotary compressor, comprising:

a sealed horizontal casing;

a hollow cylinder secured to an inner surface of said casing;

two end plates secured to both ends of said cylinder;

a roller eccentrically rotatable within said cylinder;

shaft means for rotating said roller;

a closed chamber radially extending through said cylinder, said chamber being defined by lower portions of said end plates, said end plates being made from a single piece of metal plate;

a blade in contact with an outer surface of said roller to reciprocate in said closed chamber, the axial width of said chamber being defined by said two end plates;

suction and discharge passages provided through said end plates for sending a lubricant contained in a bottom portion of said casing outside of said closed chamber into and out of said closed chamber; and a fluid diode type check valve provided in said suction passage, said check valve being press formed integrally with said metal plate.

* * * * *